US005078038A

United States Patent [19]

Clayton

[11] Patent Number: 5,078,038

[45] Date of Patent: Jan. 7, 1992

[54] AUTO HARP FIVE FINGER SYSTEM

[76] Inventor: Norman A. Clayton, 3040 Owen Ave. #1, Marina, Calif. 93933

[21] Appl. No.: 475,723

[22] Filed: Feb. 6, 1990

[51] Int. Cl.[5] ..... G10D 1/12

[52] U.S. Cl. ..... 84/285; 84/287; 84/288

[58] Field of Search ..... 84/285, 286, 287, 288, 84/289

[56] References Cited

U.S. PATENT DOCUMENTS

| | | | |
|---|---|---|---|
| 2,473,442 | 6/1949 | Page | 84/285 |
| 2,521,686 | 9/1950 | Bowen | 84/320 |
| 3,499,357 | 3/1970 | Peterson, Jr. | 84/285 |
| 4,506,583 | 3/1985 | Newton | 84/287 |

*Primary Examiner*—L. T. Hix
*Assistant Examiner*—Eddie C. Lee
*Attorney, Agent, or Firm*—Schroeder, Davis & Orliss Inc.

[57] ABSTRACT

A dampening bar assembly comprised of a pair of support blocks held in parallel spaced-apart relationship by a pair of transverse frame members attached between the support blocks at each end of the support blocks forming a rigid rectangular frame. A number of dampening bars including string vibration dampening pads mounted to the bottom side of each dampening bar are slideably mounted parallel to each other transversely between the support blocks in vertical slots formed in the opposing support block sides. Compression springs mounted in cavities formed in the bottom of each slot provide an upwardly urging force on each end of the dampening bars. Each support block includes a lengthwise aperture therethrough for receiving a square hardwood rod to retain the compression springs in a compressed configuration to provide for assembly and disassembly of the dampening bar assembly. The dampening bar assembly is designed to be used with a stringed instrument such as an auto harp. The note bars are arranged in adjacent fifth-tones or in a similar pattern to provide ease and consistency of chording and are spaced to provide effective operation without raised finger-buttons or pads requiring on the fingering surface of the note bars. The dampening bar assembly forms a complete and self-contained unit which may be retrofitted to existing instruments.

18 Claims, 5 Drawing Sheets

AUTO HARP FIVE FINGER SYSTEM

BACKGROUND OF THE INVENTION

The present invention relates generally to multi-stringed musical instruments and more particularly to harp-like instruments generally referred to as auto harps which utilize mechanical means to provide string dampening to produce desired musical chords.

A conventional auto harp comprises a relatively lightweight, portable stringed instrument similar to a zither by which musical chords are played by strumming across or plucking a number of tension strings all of which are dampened except those strings belonging to a particular desired chord. Typically, a series of chord bars extend transversely across the strings a short distance above them and have a number of dampening pads attached at selected positions which engage selected strings when a chord bar is depressed. Each chord bar then, when depressed, dampens all of the strings except those strings which constitute the notes making up a desired chord associated with a particular chord bar. Thus, the number of chords that can be played on a particular auto harp is limited to the number of chord bars available on that auto harp. In order to provide sufficient string area for a performer to pluck or strum the strings, the number of chord bars is limited to a relatively small number and thus the number of chords available to a performer is substantially less than the number of chords which may be played on the auto harp.

Improvements to the conventional auto harp described above have been made wherein rather than the use of chord bars each dampening bar is associated with certain fundamental notes. U.S. Pat. No. 4,506,583 entitled "Auto Harp" issued to William T. Newton on Mar. 26, 1985, discloses an auto harp having a plurality of note bars or octave bars supported and extending between a pair of support means such that the octave bars are above and perpendicular to the auto harp strings. Each of the octave bars is associated with a selected note in each of the plurality of octaves represented by the strings of the auto harp. Extending from and below each of the octave bars is a plurality of dampening members extending through the strings and engaging the strings from below. The octave bars are spring loaded to normally urge the dampening members against the selected strings such that when a selected octave bar is depressed the particular string or strings corresponding to the selected note is undampened and free to vibrate upon being plucked or strummed. Each octave bar further includes an adjustable stop screw received in a threaded aperture at each end of each octave bar to provide for adjustment of the spacing between the dampening member and the individual strings when the octave bar is depressed.

SUMMARY OF THE INVENTION

In accordance with the principles of the present invention a multi-stringed instrument such as the auto harp is provided which comprises a resonating box of a selected size and shape and a plurality of strings, each attached by its two ends so as to be parallel to each of the other strings and to traverse the resonating box. Strings are adapted to vibrate when strummed, each string being tuned to provide notes arranged in a plurality of octaves. The playing area is defined as all of the strings accessible for strumming from above over substantially the entirety of the playing area. A pair of support means are mounted to the resonating box near an end of the resonating box opposite the defined playing area. Each of the pair of support means is mounted such that all of the parallel strings are disposed between and parallel to the pair of support means. A plurality of dampening or note bars are supported by and extend between each of the pair of support beams such that the dampening bars are above and perpendicular to the vibrating strings, each of the note bars being associated with a selected note in each of the plurality of octaves. The note bars are arranged in fifth-tones or similar pattern to achieve ease and consistency of chording, regardless of the key being played. Each of the plurality of note bars include a plurality of dampening members equal in number to the number of octaves containing the selected note a particular note bar is associated with. Each of the dampening members is attached to and extends from a bottom side of a note bar, through the strings and includes a dampening pad located below the string corresponding to the selected note. To provide full dampening and minimize harmonics, the length of the dampening pad will exceed the width of the note bar. A resilient means such as a coil spring, cooperates with the note bars to normally urge the dampening pad of the dampening members into engagement with the selected strings such that when a selected note bar is depressed the particular string or strings corresponding to the selected note is undampened and free to vibrate upon being plucked or strummed. To provide complete flexibility of fingering, the note bars operate effectively without raised finger buttons or pads. A transverse frame member extends between and is removably attached at its ends to corresponding ends of the pair of support means thereby forming a rigid frame to allow removal and replacement of the assembled note bars and support means as a self-contained unit. Each of the pair of support means is further provided with a removable retaining means such as a square rod for maintaining the resilient means in a compressed configuration during assembly and to provide for easy disassembly of the note bars from the support means for assembly, repair and cleaning. The rigid frame thus provided maintains the assembled note bars in alignment and allows for installation of the assembled note bar unit by relatively unskilled persons. Further, the rigid frame construction of the present invention allows the note bar assembly to be manufactured as a unit and marketed as a "retrofit" kit for use with any auto harp of conventional construction.

BRIEF DESCRIPTION OF THE DRAWING

The following detailed description given by way of example will best be understood in conjunction with the accompanying drawings in which.

DETAILED DESCRIPTION OF THE PREFERRED EMBODIMENT

Figure 1:
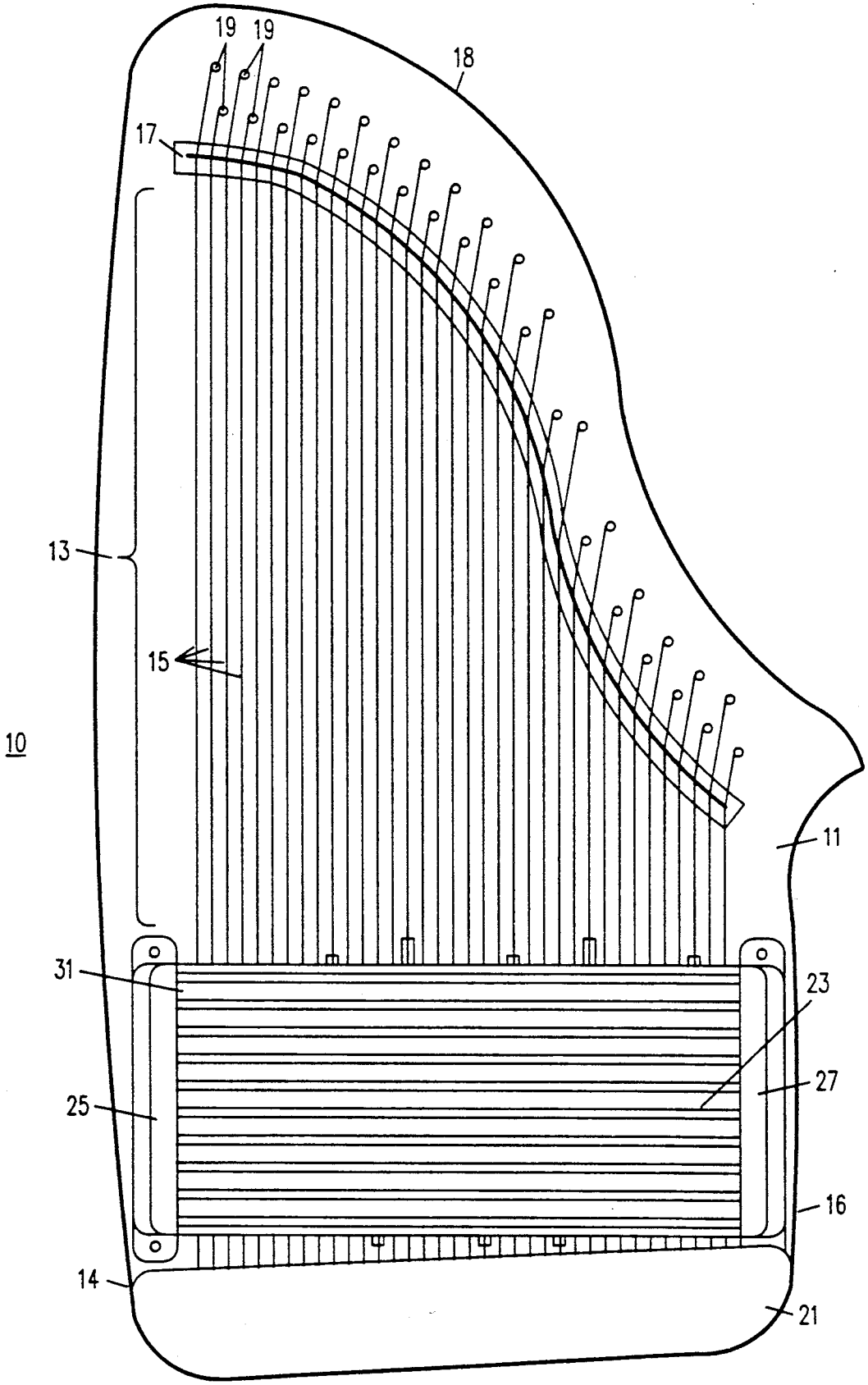
FIG. 1 is a top view of an auto harp constructed in accordance with the principles of the present invention.

Referring now to the drawings, wherein like reference numbers are used throughout to indicate like components, and in particular to FIG. 1, there is shown generally at 10 one embodiment of an auto harp in accordance with the principles of the present invention. The auto harp 10 is provided with a sounding board or resonating box 11 which may be of conventional construction formed as a hollow wooden box which may or may not include a sound hole (not shown). A plurality of strings 15 are disposed above the sounding board 11 and extend over a bridge 17 at the curved end 18 of the resonator board 11 to a base end 21. As shown, the strings 15 may vary both in diameter and in length as is provided by the curved end 18 of the auto harp. Each string 15 is attached to a tuning pin 19, the tuning pin being adapted to tighten or loosen each string 15 so as to correspondingly tune that string to a particular note. Each string 15 is fixedly secured at the base end 21, passes over the sounding board 11 and bridge 17 and then onto an associated tuning pin 19. Typically an auto harp comprises 36 separate notes or strings which comprise portions of four separate octaves of standard notes including sharps and flats. Each octave including sharps and flats constitutes twelve notes or strings. When properly tuned the auto harp strings will typically provide musical sounds extending across four consecutive octaves, such as the low octave sounds at side 14 to the highest octave sounds at side 16. It should be understood that, if desired, a lesser or greater number of octaves may be utilized. Playing of the auto harp is typically accomplished by either strumming across the face of the strings in the playing area 13 or, in most instances, individual picking of selected strings is also accomplished. To provide for the sounding of only selected ones of the strings when all of the strings are strummed, the auto harp 10 further includes a string dampening system 23 which may comprise a system of chord bars which allows only selected chords to be played or note bars as implemented in the preferred embodiment which allows individual notes and sounds other than chords to be played. The string dampening system 23 shown in the accompanying figures comprises a note bar dampening system constructed according to the principles of the present invention.

Figure 2:
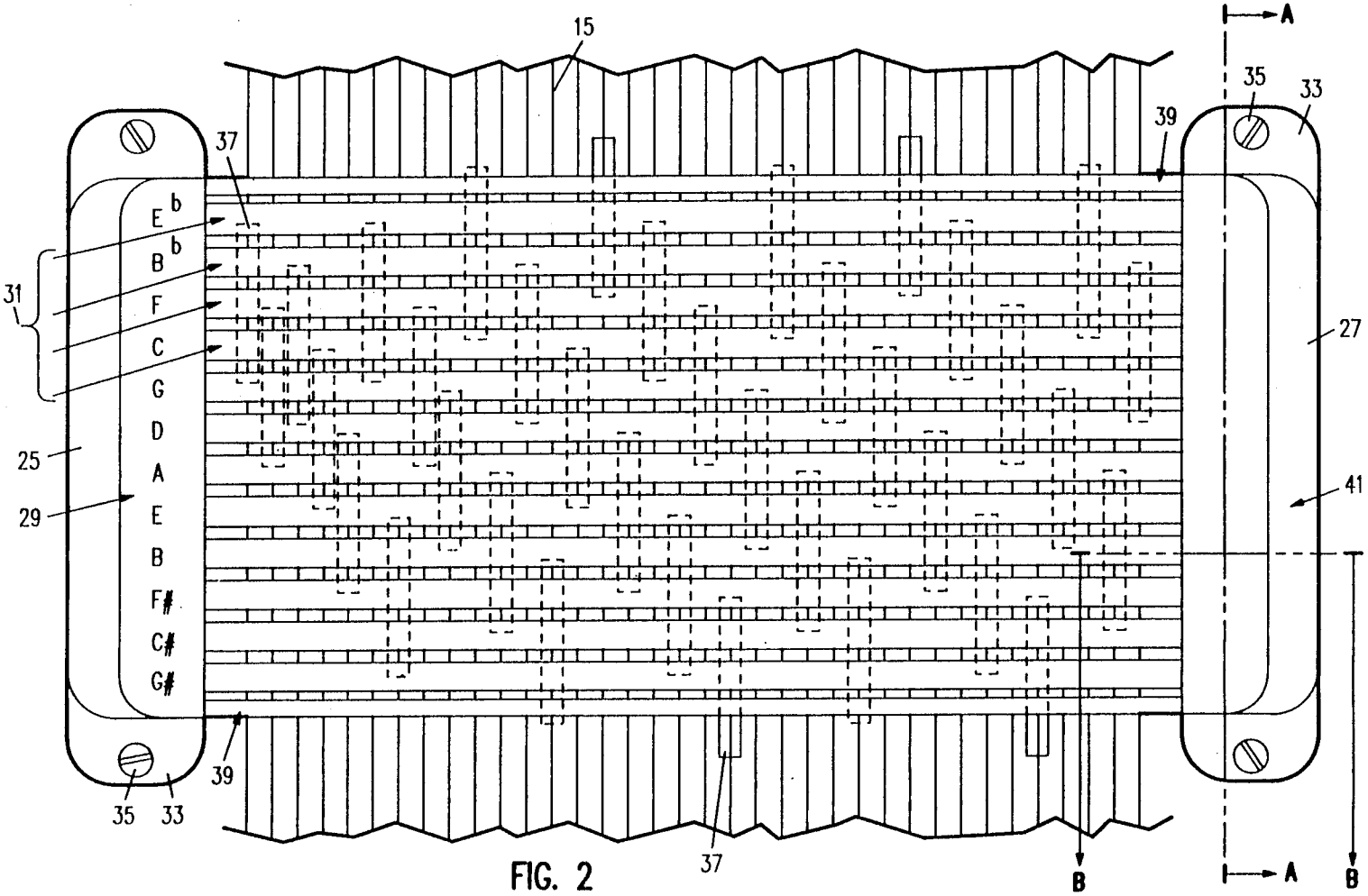
FIG. 2 is a detailed top view of the note bar assembly for the auto harp shown in FIG. 1.

Referring now also to FIG. 2, the string dampening system 23 is shown in greater detail. Support members 25 and 27 are fixedly mounted outboard of and parallel to the plurality of strings 15 in such a matter that the plurality of strings 15 are disposed between the parallel support members 25 and 27, the support members are mounted to the sounding board 11 by screws 35 or other suitable means. A plurality of note bars 31 extend transversely across and over the strings 15 between the parallel support members 25 and 27. Each of the notes bars 31 is associated with a particular note in an octave. Since the standard octave includes seven notes. A through G and five sharp and flat notes for a total of twelve notes, there will be twelve note bars, one for each note. Further, since each of the note bars 31 is associated with a selected note of each octave and since in the preferred embodiment there are four octaves, there will be no more than four strings corresponding to the selected note in each one of the octaves. The note bars 31 are arranged such that each bar 31 (except for the end note bar at each side of the pattern) is disposed between its complimentary fourth-tone and fifth-tone (with "D" towards the center of the pattern on a conventionally tuned auto harp) to provide an adjacent fifth-tone pattern or in a similar pattern to provide ease and consistency of chording. The note associated with a particular note bar 31 may be inscribed or otherwise indicated on the note bar 31 or on the top portion 29 or on both of the support members immediately adjacent the associated note bar 31 in order to identify the note which will be played if the associated note bar 31 is selected.

Figure 3A:
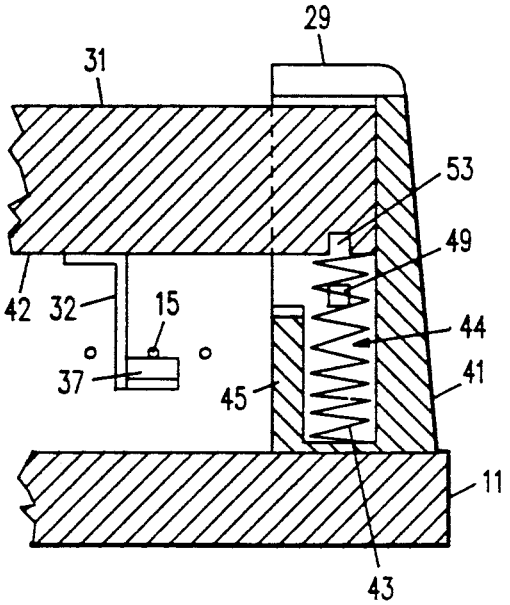
FIG. 3*a* is a side elevational view in section along line "BB" showing details of the note bar installation in a quiescent configuration of the note bar.
Figure 3B:
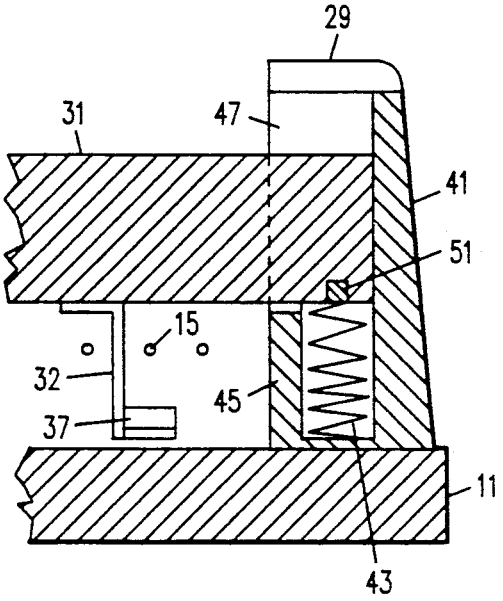
FIG. 3*b* is a side elevational view in section along line "BB" showing details of the note bar assembly in an operating configuration of the note bar.

Referring also to FIG. 3*a*, each note bar 31 includes a number of string dampening pads 37 each of which is associated with a selected note in each octave, and each of which is rigidly attached to the bottom side 42 of each note bar 31 by dampening member 32. Each dampening member 32 and its dampening pad 37 are dimensioned to provide sufficient contact area along its corresponding string 15 to fully dampen the string and minimize harmonic leakage. The dampening pads 37 are preferably at least one and one-half inches long positioned perpendicular to the note bars 31 to provide full dampening of the string 15. Alternatively, the length of the individual dampening pads 37 may be varied as a function of the pitch of its associated string 15. For example, a string having a low pitch may require a dampening pad 37 of one and one-half inches in length to provide sufficient dampening while a string having a relatively high pitch may require a dampening pad 37 of one half inch in length. The dampening members 32 may be attached to the note bar in any suitable manner such as by welding, bonding or by means of a screw. The string dampening pad 37 is attached to a lower portion of dampening member 32 and is adapted for engaging or contacting the string associated with the selected note in each octave. As shown in FIG. 3*a* the dampening members 32 extend between and through the strings 15 such that the dampening pad 37 engages the associated string from its lower side. Resilient means such as compression springs 43 are located at each end of the note bar 31 to urge the note bar 31 in an upward direction such that each dampening pad 37 is in contact with its associated string and prevents the vibration of that string unless the note bar 31 is depressed. Note bars 31 can be effectively depressed by contacting the bar at a finger contact portion comprising the center third of the note bar 31. To achieve full flexibility of fingering, the note bars 31 are sufficiently spaced to allow direct finger contact on bottonless bars without interference from adjacent note bars.

Referring now to FIGS. 3*a*, 3*b* and 3*c* and 4*a* and 4*b*, an enlarged and detailed view of how each of the note bars 31 is supported and arranged by the support members 25 and 27 is shown. A support member 27 comprises an elongated block 41 having open slots separated by walls 47 for receiving the ends of the note bars 31 formed on one side of the elongated block 41. The open slots are enclosed at the bottom by the lower portion of block 41 and with a shorter wall 45 across the front of each slot thereby forming a cavity 44. Compression spring 43 is inserted and retained in cavity 44 thus formed. Wall 45 also acts as a travel stop to control the distance that note bar 31 may be depressed and thereby also control the spacing between the dampening pad 37 and the associated strings to allow full vibration of the strings when strummed. The travel stop provided by wall 45 insures that the note bar 31 can not be depressed down so far that the bottom side 42 of the note bar 31 could contact all of the strings 15 thereby defeating the purpose of the note bar. Support wall 45 also prevents the dampening member 32 from contacting the upper surface of the resonator box 11. The support member 27 further may include top piece 29 attached to the top side of the elongated block 41 thereby providing a finished and decorative appearance. The upward travel of the note bars 31 is defined by contact of the dampening pads 37 with the strings 15.

Figure 3C:
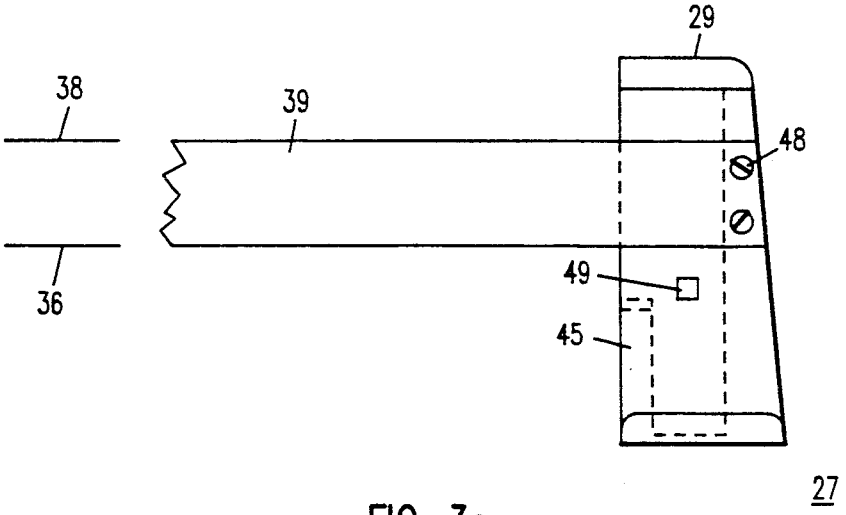
FIG. 3*c* is a side elevation view of one end of a support means illustrating attachment of a transverse frame member.
Figure 4A:
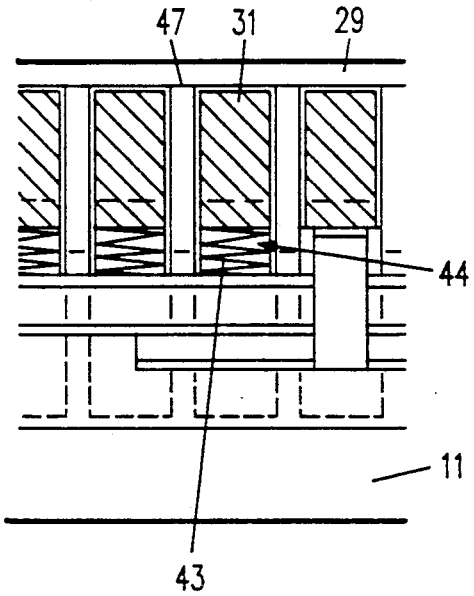
FIG. 4*a* is a side elevational view in section taken along line "AA" of FIG. 2 showing the installation of the note bars of FIG. 2.
Figure 4B:
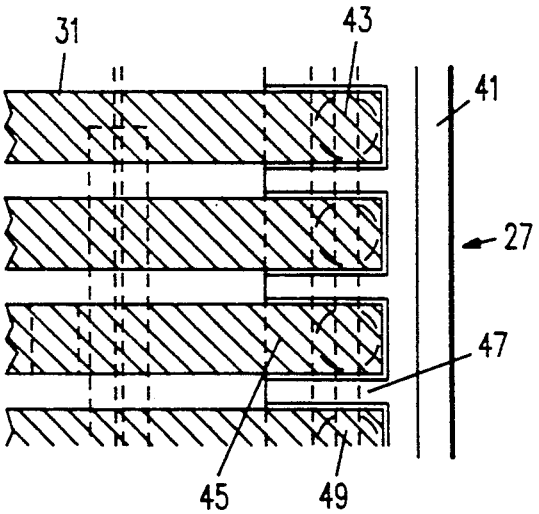
FIG. 4*b* is a top view in section showing the installation of the note bars of FIG. 2.

As shown in FIGS. 2 and 3*c* a transverse frame member 39 extends between and is attached to corresponding ends of the support members 25 and 27 to form a rigid rectangular frame. Each end of the transverse frame member 39 is removably attached to the end of the support members 25, 27 by screws 48 or other suitable means. When the note bar assembly 23 is assembled, i.e., all of the note bars 31 installed and extending between the support means 25, 27 with the transverse frame members 39 attached, note bar assembly 23 may be mounted on an auto harp sounding board 11 as a unit with screws 35. The rigid frame construction allows the bar assembly 23 to be installed or removed by the user as a unit while maintaining the proper alignment of the note bars. The transverse frame members 39 are positioned and attached such that the top edge 38 aligns with the top surface of the note bars 31 when the note bars 31 are depressed in a "down" position and bottom edge 36 aligns with the bottom surface of the note bars 31 when the note bars 31 are in their normal or "up" position. The rigid frame construction also allows the note bar assembly to be manufactured as a complete, prealigned unit and marketed as a buyer-installed retrofit kit usable with any auto harp of standard construction.

To facilitate assembly and disassembly of the note bar assembly 23, hold down means comprising a square hardwood rod 51 or other suitable material such as a metal rod, is provided to retain the compressive springs 43 in a compressed configuration to allow removal or insertion of the note bars 31 in their respective slots in the support members 25, 27. An aperture 49 is provided through each of the slot and end walls 47 just above the top of the short wall 45 which forms cavity 44. A corresponding slot 53 is formed in the bottom side of each note bar 31 at each end. When all of the note bars 31 are depressed to the top of the wall 45, the bar slots 53 align with the wall apertures 49 allowing the insertion of square rod 51.

Figure 5:
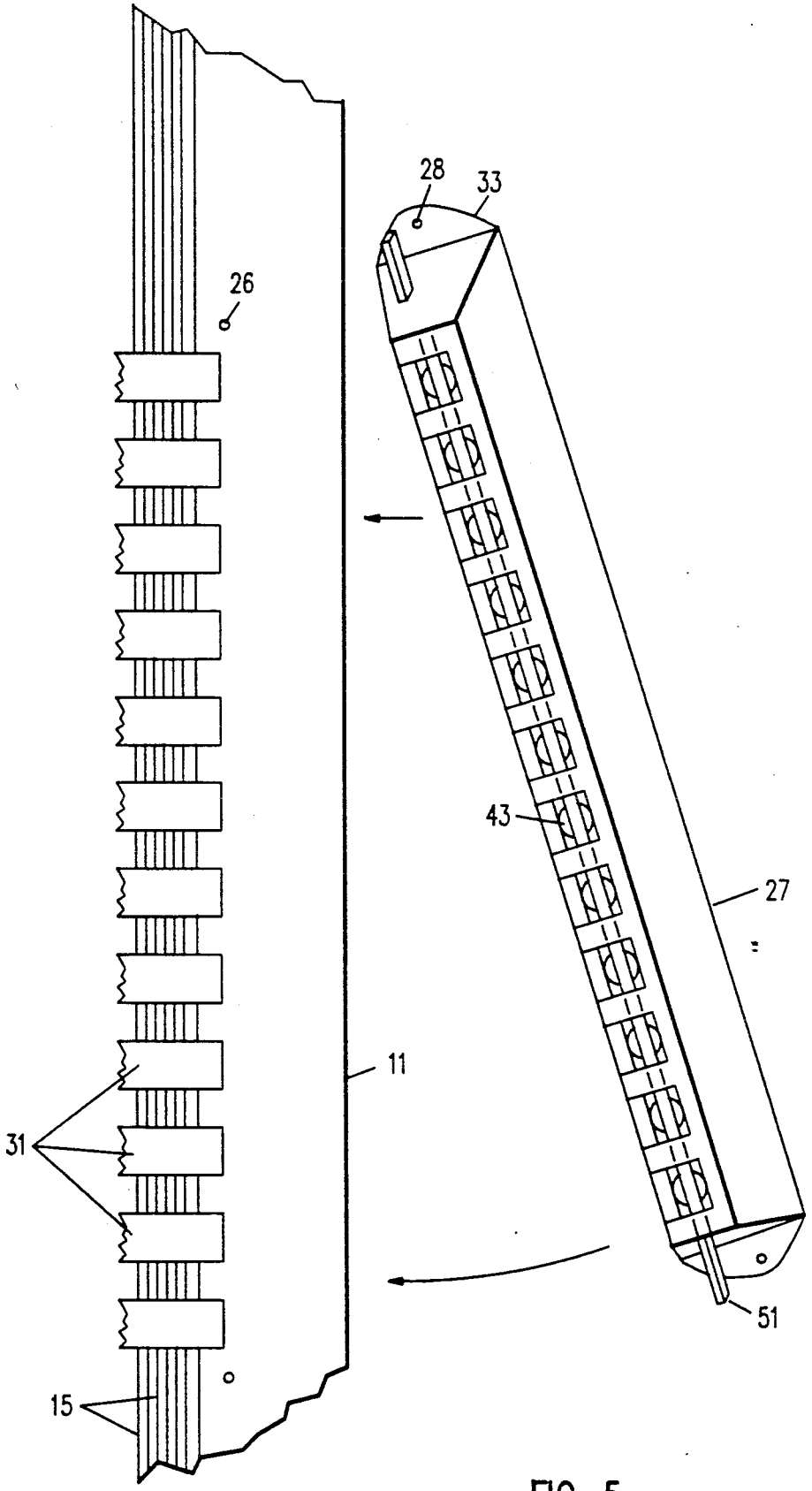
FIG. 5 is a view in perspective illustrating the disassembly of a support means from the note bars of the present invention.

Referring now also to FIG. 5, when all of the springs 43 are retained by the hold down bar 51 in a compressed configuration, a support bar 25, 27 may be removed by removing the transverse frame members 39. In order to insert or remove the note bar ends 31 in their respective slots, compression springs 43 must be depressed in a compressed configuration while the note bars 31 are in the "up" or raised position. Further, hold down of all strings facilitates an effective installation of the note bar assembly 23 since the note bars 31 must be in a depressed or down position to allow the string dampening pads 37 to be inserted between and beneath the strings 15.

While the present invention has been particularly shown and described with respect to certain preferred embodiments thereof, it should be readily apparent to those of ordinary skill in the art that various changes and modification in form and details may be made without departing from the spirit and scope of the invention as set forth in the appended claims.

I claim:

1. A dampening bar assembly for use with a multistringed instrument having a sounding board and a plurality of sounding strings adapted for vibration, each of said sounding strings attached by their ends to be parallel to each other and to traverse said sounding board such that each sounding string can be tuned to provide notes arranged in a plurality of octaves, said dampening bar assembly comprising:

a pair of elongated support means adapted to be mounted to a sounding board in a parallel configuration, said plurality of sounding strings disposed therebetween and parallel to said support means, each one of said pair of support means including a plurality of equally spaced dampening bar slots formed in an inwardly facing surface thereof at opposite sides of said plurality of sounding strings. each of said plurality of slots defined by a pair of side walls extending inwardly from said inwardly facing surface, a front wall disposed therebetween thereby forming a bottom-enclosed cavity in the lower portion of said slot;

a pair of transverse frame members, each said transverse frame member removably attached to different corresponding ends of each of said pair of support members thereby forming a rectangular shaped rigid frame;

a plurality of dampening bars, each dampening bar having first and second ends, a top side and a bottom side, said plurality of dampening bars being slidably supported by and extending between said pair of support means, such that each said dampening bar is disposed above and perpendicular to said sounding strings in such a manner that said first and second ends extend within one of said slots defined in one of said support means and in an opposing slot of said other one of said pair of support means thereby maintaining said dampening bars parallel to each other;

a plurality of dampening members rigidly attached to said bottom side each of said plurality of dampening bars, each of said plurality of dampening bars associated with a selected note, the number of dampening members attached to each said dampening bar being equal in number to the number of octaves containing said selected note;

a plurality of pairs of spring means, one each of each of said pairs disposed in said cavities of said opposing dampening bar slots formed in said pair of support means, each of said pairs of spring means cooperating with a different one of said plurality of dampening bars and operating to maintain said dampening bars in a quiescent position when said dampening bar is not depressed, each said pair of spring members urging said dampening bars to its quiescent position when said dampening bars are depressed; and a pair of hold down means for selectively maintaining said spring means in a compressed configuration thereby allowing insertion or removal of said dampening bars in said slots each of said side walls defining said slots includes an aperture transversely therethrough, said apertures aligned on a common axis for receiving said hold down means.

2. A dampening bar assembly as in claim 1 wherein said front wall further comprises a travel stop to limit travel of said dampening bars slidingly disposed in said slots.

3. A dampening bar assembly as in claim 1 wherein said hold down means comprises a rod, said rod inserted through said aligned apertures in said side walls for retaining said compression springs in a compressed configuration in said cavities when said rod is installed.

4. A dampening bar assembly as in claim 3 wherein each of said plurality of dampening bars includes a shaped notch formed in the bottom side at each end thereof, said shaped notches aligning with said side wall apertures when said dampening bars are depressed with the bottom side of the dampening bar in contact with said front wall thereby compressing said compression springs, said notches allowing said rod to be inserted through said apertures when said dampening bars are depressed.

5. A dampening bar assembly as in claim 4 wherein said assembly forms a self-contained, prealigned retrofitable unit.

6. A removable dampening bar assembly for use with a multi-stringed instrument having a sounding board with a plurality of sounding strings adapted for vibration, each of said sounding strings attached by their ends to be parallel to each other and to transverse said sounding board such that each sounding string can be tuned to provide notes arranged in a plurality of octaves, said dampening bar assembly comprising:

a pair of support means including at least one frame member attached therebetween maintaining said pair of support means in spaced-apart parallel relationship forming a rigid frame, said rigid frame adapted to be removably mounted to an instrument sounding board, a plurality of sounding strings attached to said sounding board disposed between said support means when said rigid frame is mounted on said sounding board;

a plurality of dampening bars, each said dampening bar having first and second ends, a top side and a bottom side, said plurality of dampening bars being slidably supported by and extending between said pair of support means;

a plurality of dampening members attached to each of said plurality of dampening bars, said dampening members adapted to dampen the vibrations of a sounding string, each of said dampening bars associated with at least one note;

resilient means adapted for cooperation between said support means and each of said dampening bars for maintaining said dampening bars in a first position and urging said dampening bars to return to said first position when moved from said first position; and hold down means adapted for cooperation between said support means and said plurality of dampening bars for selectively maintaining said resilient means in a compressed configuration thereby allowing assembly and disassembly of said removable dampening bar assembly.

7. A removable dampening bar assembly as in claim 6 wherein said plurality of dampening bars are arranged in a side-by-side relationship such that associated sounding strings of adjacent dampening bars comprise fifth-tones thereby providing groups of similarly patterned dampening bars associated with selected chords, the dampening bars in each of said groups being disposed in close proximity to one another.

8. A removable dampening bar assembly as in claim 6 wherein said pair of support means comprise elongated blocks disposed in parallel configuration and having a plurality of vertical slots formed in the facing sides of said parallel support blocks, each of said dampening bar slideably mounted in an opposing pair of said slots and extending transversely between said pair of support blocks, said slots adapted to allow vertical motion of said dampening bars therein, said vertical slots separated by side walls.

9. A removable dampening bar assembly as in claim 8 wherein each said vertical slot is enclosed at its lower end forming a cavity thereat, said resilient means mounted in said cavity.

10. A removable dampening bar assembly as in claim 9 wherein each said cavity includes a front wall formed in said facing side of said support block, said front wall adapted for providing a lower travel stop for said vertical motion of said dampening bars.

11. A removable dampening bar assembly as in claim 9 wherein said resilient means comprises a plurality of spring means, one of said plurality of spring means disposed within each of said cavities between one end of a dampening bar mounted therein and said support block, said spring means adapted to urge said dampening bar end in a vertically upward direction.

12. A removable bar assembly as in claim 11 wherein each said spring means comprise a coil spring.

13. A removable dampening bar assembly as in claim 10 wherein each said support block includes an aperture defined lengthwise through said support block, said aperture extending through the walls separating each of said cavities, said lengthwise aperture for receiving said hold down means, said hold down means maintaining each of said spring means in a compressed configuration.

14. A removable dampening bar assembly as in claim 13 wherein said hold down means comprises an elongated rod.

15. A removable dampening bar assembly as in claim 14 wherein said hold down means comprises an elongated square rod of hardwood.

16. A removable dampening bar assembly as in claim 14 wherein each of said dampening bars include a shaped notch formed in the bottom side at first and second ends thereof, said shaped notches conforming to the cross-sectional shape of said elongated rod and aligning with said side wall apertures when said dampening bars are depressed with the bottom side of the dampening bar in contact with said front wall thereby compressing said spring means, said notches for receiving said elongated rod and allowing said elongated rod to be inserted through said apertures.

17. A removable dampening bar assembly as in claim 16 wherein said elongated rod comprises a square rod of hardwood.

18. A removable dampening bar assembly as in claim 16 wherein the length of each of said dampening members exceeds the width of its associated dampening bar.

* * * * *